US006989791B2

(12) United States Patent
Navarro et al.

(10) Patent No.: US 6,989,791 B2
(45) Date of Patent: Jan. 24, 2006

(54) ANTENNA-INTEGRATED PRINTED WIRING BOARD ASSEMBLY FOR A PHASED ARRAY ANTENNA SYSTEM

(75) Inventors: Julio Angel Navarro, Kent, WA (US); Geoffrey O. White, Kent, WA (US)

(73) Assignee: The Boeing Company, Chicago, IL (US)

( * ) Notice: Subject to any disclaimer, the term of this patent is extended or adjusted under 35 U.S.C. 154(b) by 288 days.

(21) Appl. No.: 10/200,088

(22) Filed: Jul. 19, 2002

(65) Prior Publication Data

US 2004/0012533 A1 Jan. 22, 2004

(51) Int. Cl.
*H01Q 1/38* (2006.01)

(52) U.S. Cl. ..... 343/700 MS; 343/846

(58) Field of Classification Search ..... 343/700 MS, 343/846, 829, 830, 831, 848, 770, 789; H01Q 1/38
See application file for complete search history.

(56) References Cited

U.S. PATENT DOCUMENTS 5,008,678 A 4/1991 Herman
5,136,304 A 8/1992 Peters
5,276,455 A 1/1994 Fitzsimmons et al.
5,434,581 A * 7/1995 Raguenet et al. .... 343/700 MS
5,539,420 A * 7/1996 Dusseux et al. ..... 343/769
5,825,333 A 10/1998 Kudoh et al.
5,886,671 A 3/1999 Riemer et al.
6,018,659 A 1/2000 Ayyagari et al.
6,211,824 B1 * 4/2001 Holden et al. ..... 343/700 MS
6,407,704 B1 * 6/2002 Franey et al. ..... 343/700 MS

OTHER PUBLICATIONS

Publication from Microwave Journal, Jan. 1994, entitled "A Connectorless Module for an EHF Phased–Array Antenna".

* cited by examiner

*Primary Examiner*—Hoanganh Le
(74) *Attorney, Agent, or Firm*—Harness Dickey & Pierce P.L.C.

(57) ABSTRACT

A phased array antenna system including a plurality of metal, column-like elements formed adjacent the RF probes for improving the electrical performance of the system. In one embodiment a hole is formed in a multi-layer, probe-integrated printed wiring board of the system and metal material is plated thereon to fill the hole. The metal, column-like elements are each disposed generally in between associated pairs of the RF probes. The metal, column-like elements essentially form metal pins that improve the return loss bandwidth, probe-to-probe isolation, insertion loss bandwidth, higher order mode suppression and cross-polarization generation.

18 Claims, 12 Drawing Sheets

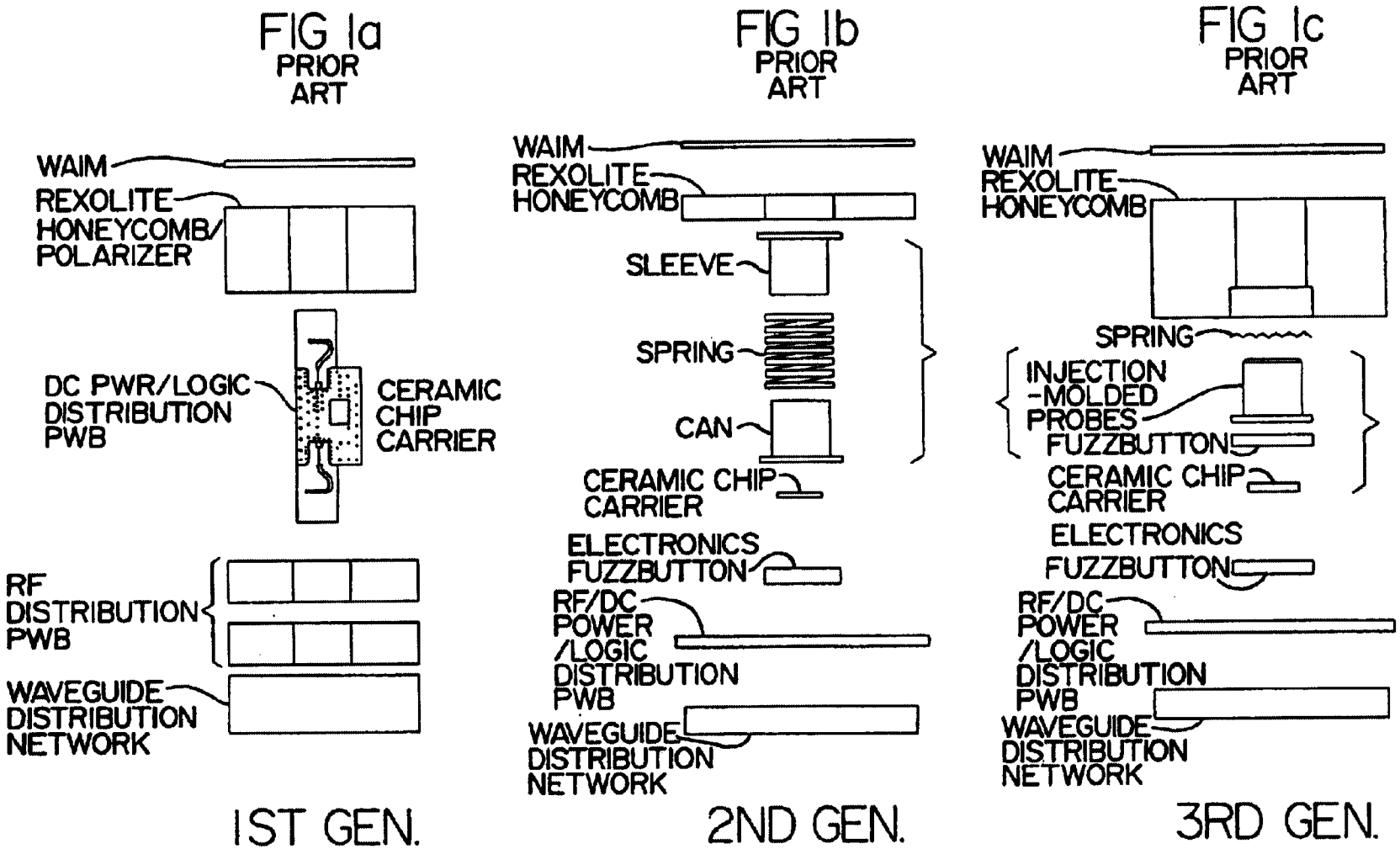
FIG 1c
PRIOR ART
WAIM
REXOLITE HONEYCOMB
SPRING
INJECTION -MOLDED PROBES
FUZZBUTTON
CERAMIC CHIP CARRIER
ELECTRONICS
FUZZBUTTON
RF/DC POWER /LOGIC DISTRIBUTION PWB
WAVEGUIDE DISTRIBUTION NETWORK
3RD GEN.
FIG 1b
PRIOR ART
WAIM
REXOLITE HONEYCOMB
SLEEVE
SPRING
CAN
CERAMIC CHIP CARRIER
ELECTRONICS
FUZZBUTTON
RF/DC POWER /LOGIC DISTRIBUTION PWB
WAVEGUIDE DISTRIBUTION NETWORK
2ND GEN.
FIG 1a
PRIOR ART
WAIM
REXOLITE HONEYCOMB POLARIZER
CERAMIC CHIP CARRIER
DC PWR/LOGIC DISTRIBUTION PWB
RF DISTRIBUTION PWB
WAVEGUIDE DISTRIBUTION NETWORK
1ST GEN.

20
10
14
4
4
12
16
18
3
3

14a
14b 28
28
14q 22b
5
22a
6
6
12a 12h
12o
24
18
24

100
104
102
106
110
108
108
9
9

INCREASED HIGHER ORDER MODE SUPPRESSION

HIGHER ORDER MODE SUPPRESSION (TM01 MODE)

BASELINE: [32 dB @ 10.8 GHz (6 dB/GHz SLOPE)]]

MODIFICATION: [32 dB @ 10.8 GHz (-1.25 dB/GHz SLOPE]

ANTENNA-INTEGRATED PRINTED WIRING BOARD ASSEMBLY FOR A PHASED ARRAY ANTENNA SYSTEM

FIELD OF THE INVENTION

The present invention relates to phased array antennas, and more particularly to a phased array antenna system incorporating at least one antenna module, and more preferably a plurality of antenna modules, and where each antenna module includes a metal column-like member that significantly improves cross polarization isolation between the RF radiating elements of each antenna module.

BACKGROUND OF THE INVENTION

The assignee of the present application, The Boeing Company, is a leading innovator in the design of high performance, low cost, compact phased array antenna modules. The Boeing antenna module shown in FIGS. 1*a*–1*c* have been used in many military and commercial phased array antennas from X-band to Q-band. These modules are described in U.S. Pat. No. 5,886,671 to Riemer et al and U.S. Pat. No. 5,276,455 to Fitzsimmons et al, both being hereby incorporated by reference.

The in-line first generation module was used in a brick-style phased-array architecture at K-band and Q-band frequencies. This approach is shown in FIG. 1*a*. This approach requires some complexity for DC power, logic and RF distribution but it provides ample room for electronics. As Boeing phased array antenna module technology has matured, many efforts made in the development of module technology resulted in reduced parts count, reduced complexity and reduced cost of several key components of these antenna modules. Boeing has also enhanced the performance of the phased array antenna with multiple beams, wider instantaneous bandwidths and greater polarization flexibility.

The second generation module, shown in FIG. 1*b*, represented a significant improvement over the in-line module of FIG. 1*a* in terms of performance, complexity and cost. It is sometimes referred to as the "can and spring" design. This design provides dual orthogonal polarization in an even more compact, lower-profile package than the in-line module of FIG. 1*a*. The can-and-spring module forms the basis for several dual simultaneous beam phased arrays used in tile-type antenna architectures from X-band to K-band. The can and spring module was later improved even further through the use of chemical etching, metal forming and injection molding technology. The third generation module developed by the assignee, shown in FIG. 1*c*, provides an even lower-cost production design adapted for use in a dual polarization receive phased array antenna.

Each of the phased-array antenna module architectures shown in FIGS. 1*a*–1*c* require multiple module components and interconnects. In each module, a relatively large plurality of vertical interconnects such as buttons and springs are used to provide DC and RF connectivity between the distribution printed wiring board (PWB), ceramic chip carrier and antenna probes.

A further step directed to reduce the parts count and assembly complexity of the antenna module as described above is described in pending U.S. patent application Ser. No. 09/915,836, "Antenna Integrated Ceramic Chip Carrier For A Phased Array Antenna", hereby incorporated by reference into the present specification This application involves forming an antenna integrated ceramic chip carrier (AICC) module which combines the antenna probe (or probes) of the phased array module with the ceramic chip carrier that contains the module electronics into a single integrated ceramic component. The AICC module eliminates vertical interconnects between the ceramic chip carrier and antenna probes and takes advantage of the fine line accuracy and repeatability of multi-layer, co-fired ceramic technology. This metallization accuracy, multi-layer registration produces a more repeatable, stable design over process variations. The use of mature ceramic technology also provides enhanced flexibility, layout and signal routing through the availability of stacked, blind and buried vias between internal layers, with no fundamental limit to the layer count in the ceramic stack-up of the module. The resulting AICC module has fewer independent components for assembly, improved dimensional precision and increased reliability.

In spite of the foregoing improvements in antenna module design, there is still a need to further combine more functions of a phased array antenna into a single component. This would further reduce the parts count, improve alignment and mechanical tolerances during manufacturing and assembly, improve electrical performance, and reduce assembly time and processes to ultimately reduce phased array antenna system costs. More specifically, it would be highly desirable to substantially reduce or eliminate dielectric "pucks" that need to be used in a completed antenna module, as well as to entirely eliminate the use of buttons, button holders, flex members, cans, sleeves, elastomers and springs. If all of these independent parts could be substantially reduced in number or eliminated, then the primary issue bearing on the cost of the antenna assembly would be the material and process cost of manufacturing the antenna assembly.

For each of the dual polarization antenna modules/systems described above, there are several characteristics used to gauge the effectiveness (i.e., electrical performance) of the design. These characteristics include return loss bandwidth, radiator-to-radiator isolation, insertion loss bandwidth, higher order mode suppression and cross-polarization levels. All of these characteristics affect the overall electrical performance of the antenna module/system. Therefore, it would be highly desirable if these characteristics could be favorably influenced through a new antenna module design which does not involve the use of numerous and/or costly additional components parts, and which further does not significantly complicate the construction of the various antenna module/system designs described above.

SUMMARY OF THE INVENTION

The present invention is directed to a phased array antenna system which incorporates an antenna integrated printed wiring board (AIPWB) assembly. The AIPWB assembly includes circuitry for DC/logic and RF power distribution as well as the antenna probes. The metal honeycomb waveguide plate used with previous designs of phased array antenna modules is eliminated in favor of a multi-layer printed wiring board which includes vias which form circular waveguides and a plurality of layers (stack-up) for providing a honeycomb waveguide structure and wide angle impedance matching network (WAIM). Thus, the antenna system of the present invention completely eliminates the need for dielectric pucks, which previous designs of phased array antenna modules have heretofore required. The entire phased array antenna system is thus formed from at least one multi-layer printed wiring board, or alternatively from two or more multi-layer printed wiring boards placed adjacent to one another. This construction significantly reduces the independent number of component parts required to produce a phased array antenna system. Each of the two printed wiring boards are produced using an inexpensive, photolithographic process. Forming the entire antenna system essentially into one or two, or possibly more, printed wiring boards significantly eases the assembly of the phased array antenna system, as well as significantly reducing its manufacturing cost.

In an alternative preferred embodiment of the present invention the antenna system incorporates a metal, column-like element adjacent each pair of antenna probes. The metal, column-like elements are formed in the AIPWB assembly during manufacture. In one preferred manufacturing implementation a plurality of small diameter bores are formed in the AIPWB, with each bore being adjacent, and more preferably in between, each pair of RF probes. Metal is then deposited in each of the bores to form a corresponding plurality of metal, column-like elements. The metal-column like elements effectively form metal "pins", with each metal pin being associated with a particular pair of probes. antenna probes.

The metal, column-like elements significantly improve the overall electrical performance of the probes, and thus the antenna system, by favorably influencing the return loss bandwidth, probe-to-probe cross polarization isolation, insertion loss bandwidth, and the higher order mode suppression of the antenna system. This results in an improved operating bandwidth for a given antenna system. If increased bandwidth is not needed for a given application, these improvements then allow component tolerances to be relaxed, thus increasing the manufacturing yield for such an antenna system. The electrical variations in an array environment, over a range of scan angles, are also reduced by the improvement in operating bandwidth. Importantly, the inclusion of the metal, column-like elements does not significantly complicate the manufacturing process nor does it significantly increase the overall cost of the antenna system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 1*a*–1*c* represent prior art module designs of the assignee of the present invention;

DETAILED DESCRIPTION OF THE PREFERRED EMBODIMENTS

The following description of the preferred embodiment(s) is merely exemplary in nature and is in no way intended to limit the invention, its application, or uses.

Figure 2:
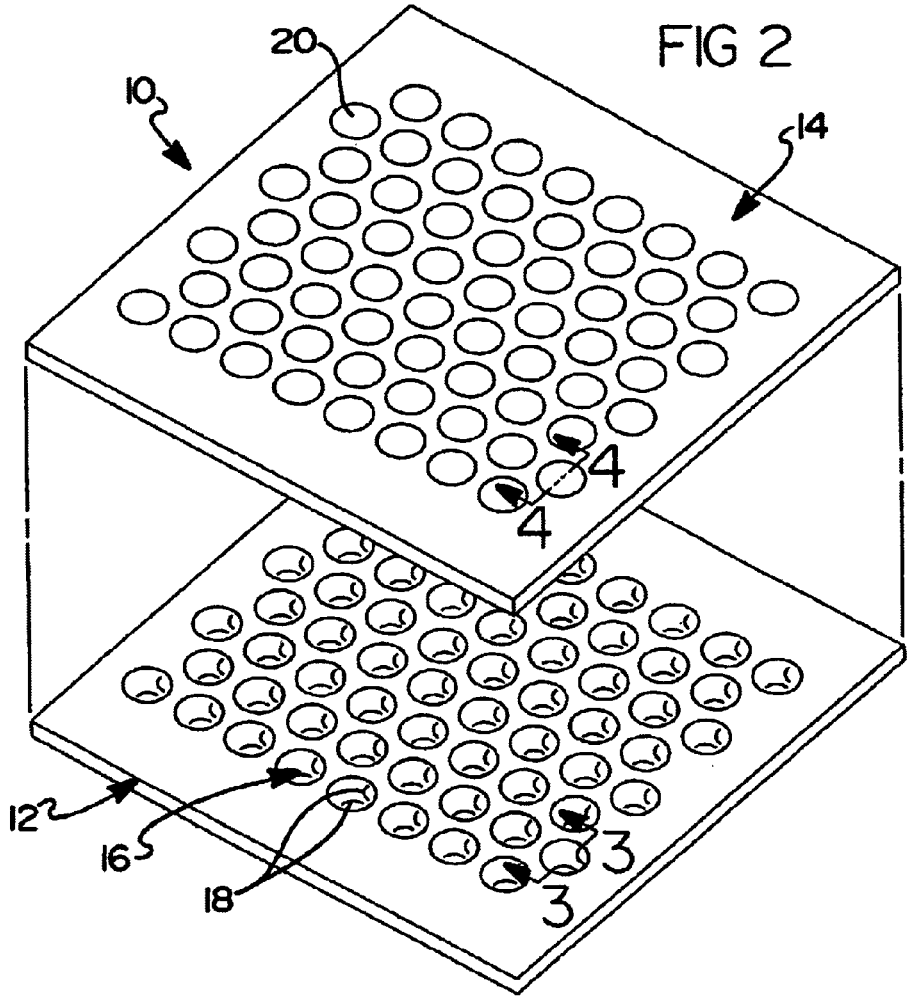
FIG. 2 is an exploded perspective view of the two major components forming a 64 element phased array antenna system in accordance with a preferred embodiment of the present invention.

Referring to FIG. 2, there is illustrated a pre-assembled view of a 64 element phased array antenna system 10 in accordance with a preferred embodiment of the present invention. It will be appreciated immediately, however, that the present invention is not limited to a 64 element phased array antenna system, but that the principles and teachings set forth herein could be used to produce phased array antenna systems having a greater or lesser plurality of antenna elements. The phased array antenna system 10 incorporates a multi-layer probe-integrated printed wiring board 12 and a multi-layer waveguide printed wiring board 14 which are adapted to be disposed adjacent one another in abutting relationship when fully assembled. Conventional threaded or non-threaded fasteners (not shown) can be used to secure the two wiring boards 12 and 14 in close, secure abutting contact. The probe-integrated printed wiring board 12 includes a plurality of antenna elements or modules 16 arranged in an 8×8 grid. Each antenna element 16 includes a pair of radio frequency (RF) probes 18, but it will be appreciated again that merely a single probe could be incorporated, if desired, and that greater than two probes could be included just as well to meet the needs of a specific application.

The multi-layer waveguide printed wiring board 14 includes a plurality of integrally formed circular waveguides 20 formed to overlay each of the antenna elements 16. It will be appreciated that these circular waveguides 20 are integrally formed areas or portions of the waveguide printed wiring board 14 and not independent dielectric pucks. It will also be appreciated that as the operating frequency of the antenna system 10 increases, the thickness of the wiring board 14 will decrease. Conversely, as the operating frequency decreases, the thickness of the board 14 will increase.

Figure 3:
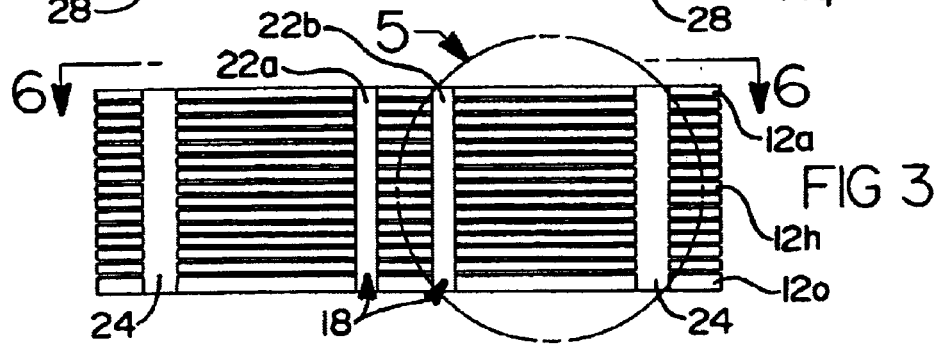
FIG. 3 is a cross sectional side view through one antenna site taken in accordance with section line 3—3 in FIG. 2.
Figure 6:
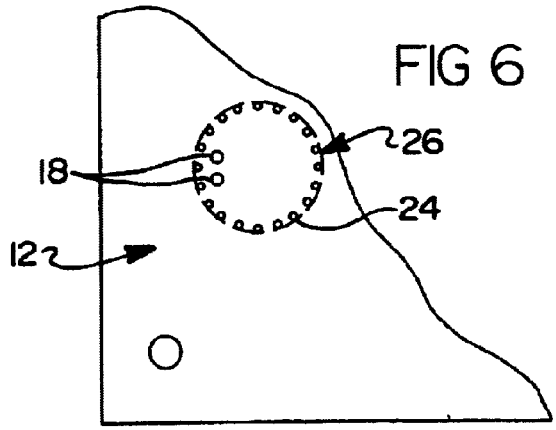
FIG. 6 is a plan view of a portion of the probe-integrated wiring board showing the vias that form the can for each pair of RF radiating elements.

Referring to FIG. 3, the probe-integrated printed wiring board 12 can be seen to include a plurality of 15 independent layers 12*a*–12*o* sandwiched together. Again, it will be appreciated that a greater or lesser plurality of layers could be provided to meet the needs of a specific application. RF vias 22*a* and 22*b* are used to form the probes 18 while vias 24 are arranged circumferentially around the vias 22*a* and 22*b* to effectively form a "cage" or "can" 26 for the antenna element 16. This is illustrated in greater detail in FIG. 6. It will be appreciated that the illustration of 20 vias to form the can 26 in FIG. 6 is presented for illustrative purposes only, and that a greater or lesser plurality of vias 24 could be employed. Also, it will be appreciated that the spacing of the vias 24 does affect how closely the cage 26 approximates a physical can, in an electromagnetic sense.

Figure 4:
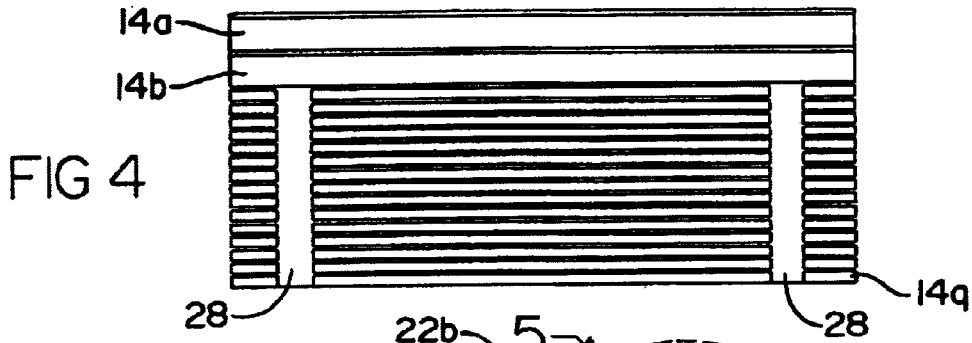
FIG. 4 is a cross sectional side view taken in accordance with section line 4—4 through the upper printed wiring board shown in FIG. 2 illustrating the vias used for forming a circular waveguide, honeycomb support structure, and the stack-up for the wide angle impedance matching network (WAIM)

Referring now to FIG. 4, the waveguide printed wiring board can be seen to also include a plurality of independent layers 14*a*–14*q* which form a wide angle impedance matching network (WAIM). Vias 28 extending through layers 14*c*–14*q*, form the waveguide portion of the wiring board 14. Again, it will be appreciated that vias 28 are arranged in circular orientations such as shown in FIG. 6. Layers 14*a* and 14*b* form impedance matching layers.

Each of the printed wiring boards 12 and 14 are formed through an inexpensive, photolithographic process such that each wiring board 12 and 14 is formed as a multi-layer part. The probe-integrated printed wiring board 12 includes the antenna probes 18 and DC/logic and RF distribution circuitry. On probe-integrated printed wiring board 12, the discrete electronic components (i.e., MMICs, ASICs, capacitors, resistors, etc) can be placed and enclosed by a suitable lid or cover (not shown) on a bottom surface of layer 12*o*. Accordingly, the multiple electrical and mechanical functions of radiation, RF distribution, DC power and logic are all taken care of by the probe-integrated printed wiring board 12.

Figure 5:
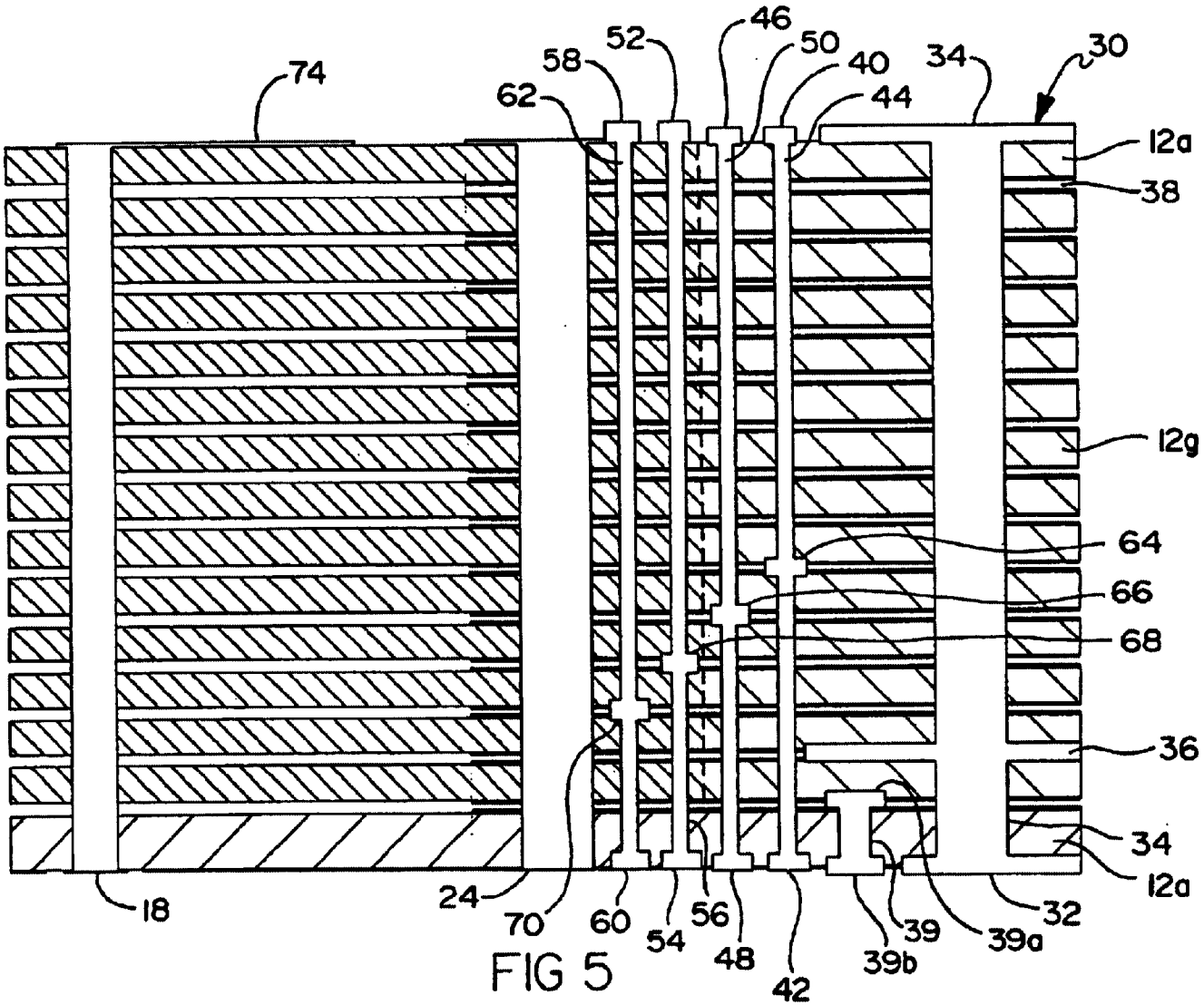
FIG. 5 is a detailed, side cross sectional view of portion 5 of the probe-integrated printing wiring board of FIG. 3 illustrating in greater detail the electrical interconnections formed within the layers of this printed wiring board assembly.

Referring now to FIG. 5, the probe-integrated printed wiring board 12 is shown in further detail. Layer 12*a* comprises a ground pad 30 on an outer surface thereof. Ground pad 30 is electrically coupled to a ground pad 32 on an outer surface of layer 120 by a conductive via 34 extending through each of the layers 12*a*–12*o*. Via 34 is also electrically coupled to an RF ground circuit trace 36. Layers 12*a*–12*i* are separated by ground layers 38. The ground layers help to reduce the inductance of the vias formed in the board 12.

With further reference to FIG. 5, via 39 and pads 39*a* and 39*b* provide electrical coupling to layer 12*o*, which forms a stripline for distributing RF energy between the RF probes 18 and the vias 39. It will be appreciated that for a 64 element phased array antenna, there will be 64 of the vias 39, with each via 39 associated with one of the 64 antenna elements.

Referring further to FIG. 5, pad 40 on layer 12*a* and pad 42 on layer 12*o* are electrically coupled by a conductive via 44. Pad 46 on layer 12*a* and pad 48 on layer 12*o* are electrically coupled by conductive via 50. Pad 52 on layer 12*a* and pad 54 on layer 12*o* are electrically coupled by conductive via 56, while pad 58 on layer 12*a* and pad 60 on layer 120 are electrically coupled by conductive via 62. Via 44 extends completely through all of the layers 12*a*–12*o* and is also electrically coupled to a clock circuit trace 64. Via 50 extends through all of the layers 12*a*–12*o* and is electrically coupled to a data circuit trace 66. Via 56 extends through all of layers 12*a*–12*o* and is electrically coupled to a DC source (−5V) circuit trace 68. Via 62 likewise extends through all of layers 12*a*–12*o* and is electrically coupled to another DC power (+5V) circuit trace 70.

One via 24 is shown which helps to form the can 26 (FIG. 6). Via 24 is essentially a conductive column of material that extends through each of layers 12*a*–12*o*. Finally, one of the RF vias 18 is illustrated. Via 18 extends through each of layers 12*a*–12*o* and includes a perpendicularly extending leg 74 formed on an outer surface of layer 12*a*. Leg 74 defines a surface plane, and the vias 28 (FIG. 4) of the printed wiring board extend beyond the surface plane to perform a waveguide function.

Again, however, it will be appreciated that the drawing of FIG. 5 represents only a very small cross sectional portion of the probe-integrated printed wiring board 12. In practice, a large plurality of RF probe vias 18, and a large plurality of vias 24 for forming the can 26, will be implemented. For the phased array antenna system 10 shown in FIG. 2, 128 RF probe vias 18 are formed in the probe-integrated printed wiring board 12, together with a much larger plurality of vias 24. Also, it will be appreciated that the various electronic components used with the antenna system 10, although not shown, will be secured adjacent layer 12P in FIG. 5.

Figure 7:
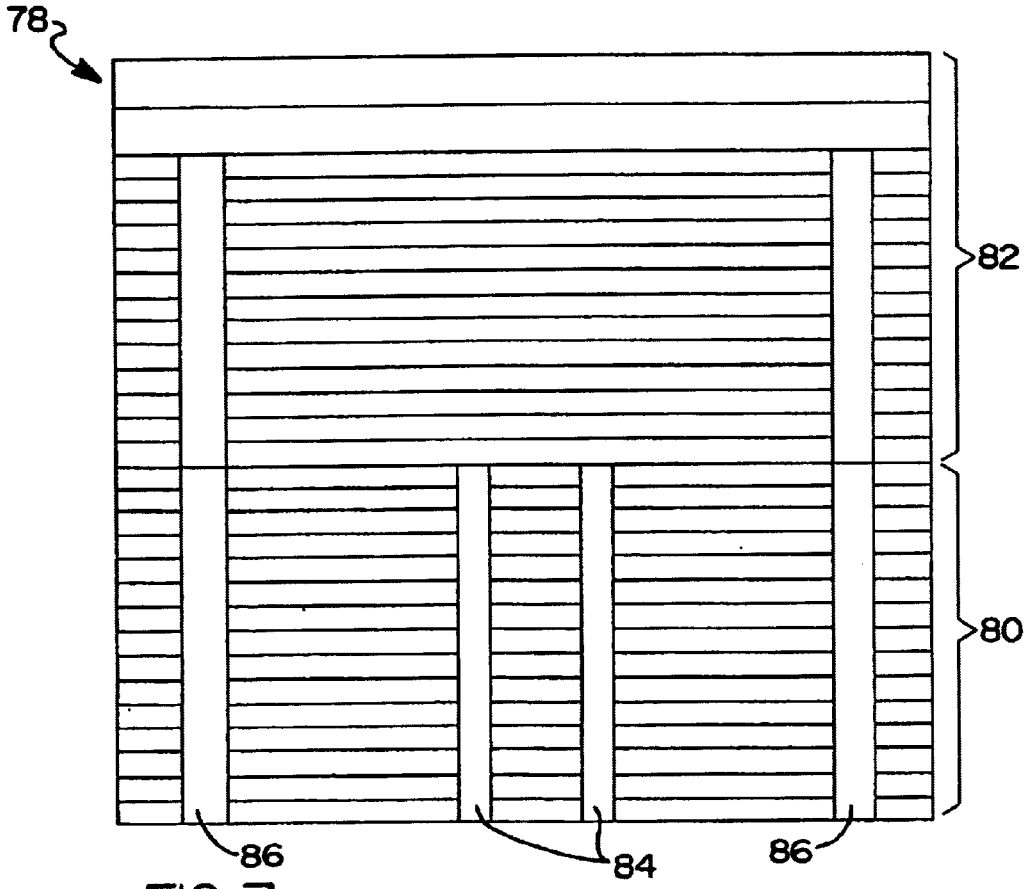
FIG. 7 is a view of an alternative preferred embodiment of the present invention wherein the probe-integrated printed wiring board and the waveguide printed wiring board are formed as a single, integrated, multi-layer printed wiring board.

It will also be appreciated that the probe-integrated printed wiring board 12 and the waveguide printed wiring board 14 could just as easily be formed as one integrally formed, multi-layer printed wiring board to form an antenna system 10 in accordance with an alternative preferred embodiment of the present invention. Such an implementation is illustrated in the cross sectional drawing of FIG. 7, wherein reference numeral 78 denotes the single multi-layer printed wiring board which includes a probe-integrated printed wiring board portion 80 and a waveguide printed wiring board portion 82. RF vias 84 extend through both boards 80, while a plurality of vias 86 forming the can extend through both boards 80 and 82.

Figure 8:
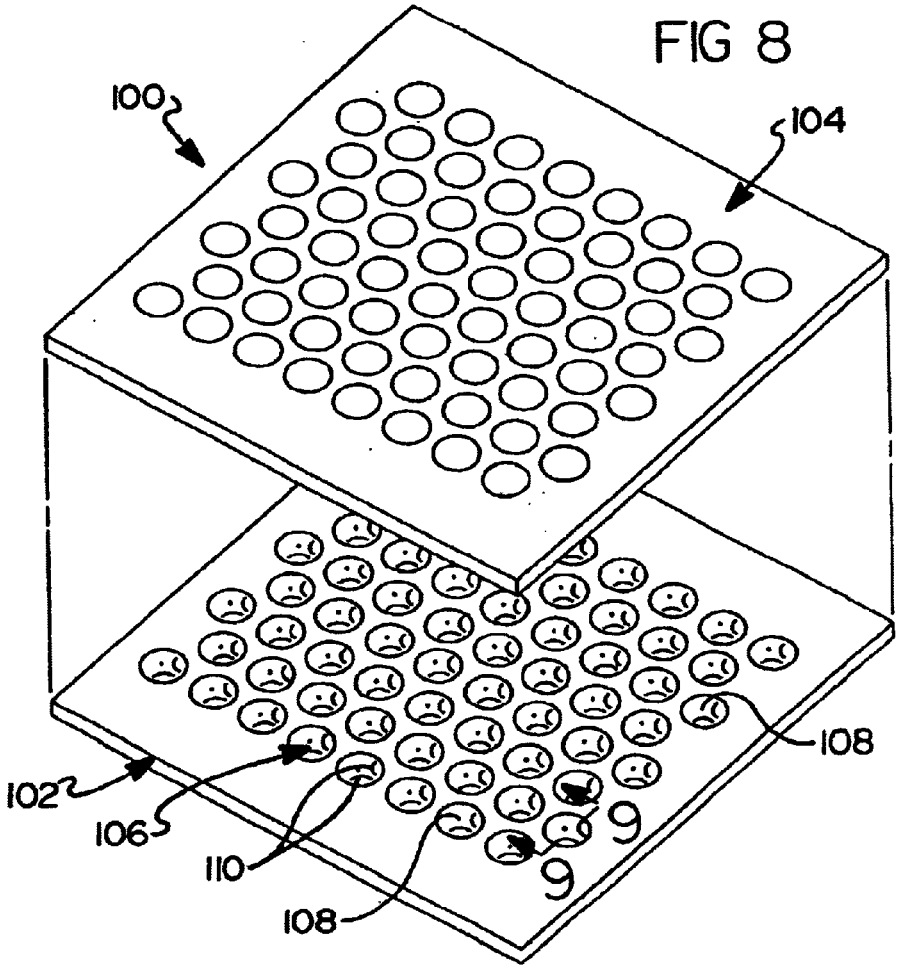
FIG. 8 is a view of an antenna system in accordance with an alternative preferred embodiment of the present invention, in which the probe-integrated wiring board of FIG. 2 has been modified to include metal, column-like elements adjacent each pair of RF probes.
Figure 9:
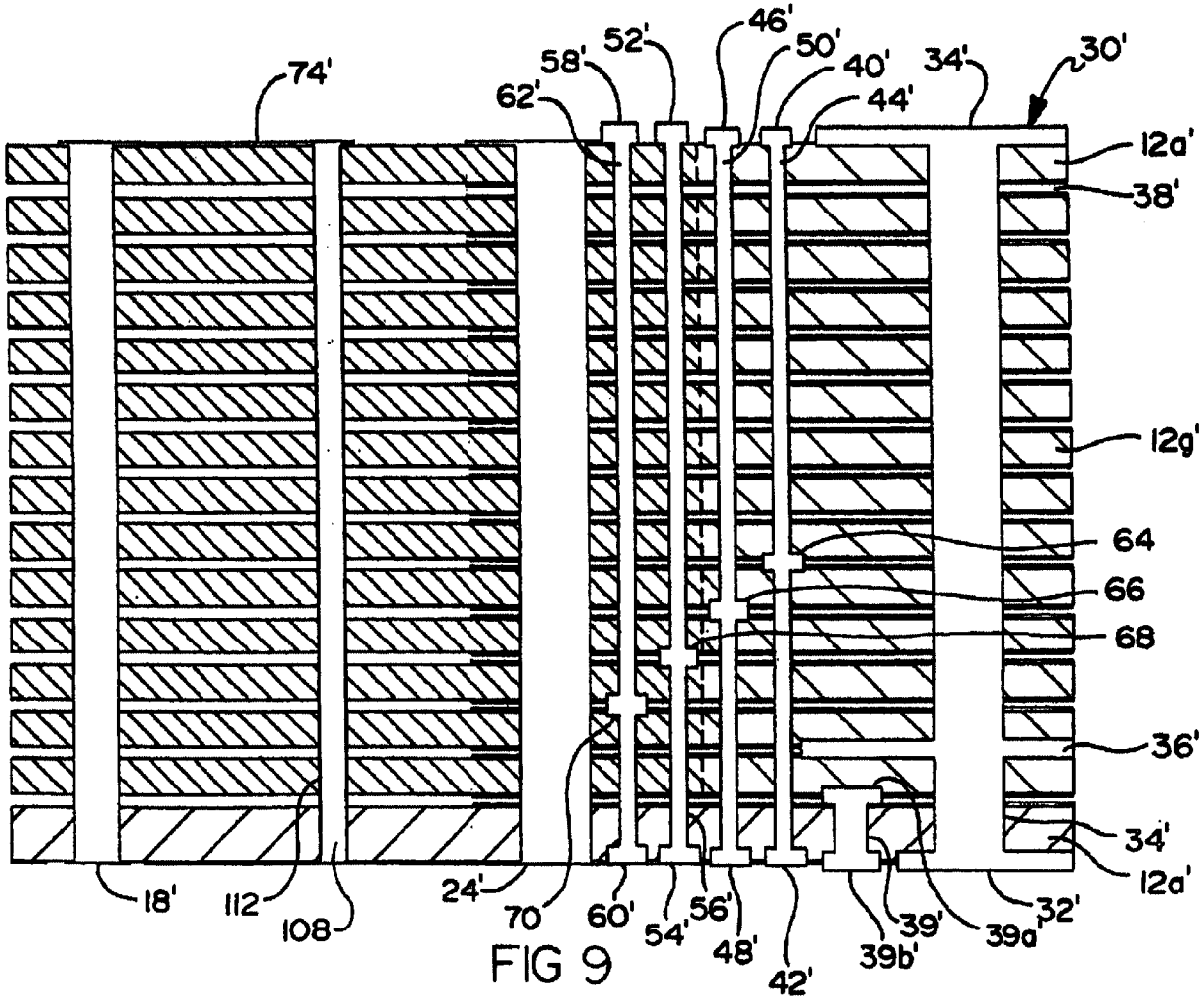
FIG. 9 is a cross-sectional side view of the probe-integrated wiring board of FIG. 8 illustrating one of the metal, column-like elements disposed adjacent one of the RF probes.

Referring now to FIGS. 8 and 9, an antenna system 100 in accordance with an alternative preferred embodiment of the present invention is shown. With specific reference to FIG. 8, antenna system 100 includes a multi-layer, probe-integrated printed wiring board 102 and a multi-layer, waveguide integrated printed wiring board 104. The waveguide integrated printed wiring board 104 is identical in construction to the waveguide integrated printed wiring board 14. The probe-integrated printed wiring board 102 is identical to the probe-integrated printed wiring board 12 with the exception that each antenna module 106 thereof includes a metal, column-like element 108 formed adjacent to its associated pair of RF probes 110. Preferably, each metal, column-like element 108 is disposed centrally in between its associated pair of probes 110. This placement could be modified as needed to meet the specific design requirements of a given antenna. However, placing each metal, column-like element 108 symmetrically relative to its associated probes will help to reduce cross-talk and suppress higher order modes. The metal column-like elements 108 significantly further improve the overall performance of the antenna system 100 over dual probe antenna systems that do not incorporate such elements. Specific areas of improvement in antenna performance will be discussed further in the following paragraphs.

Referring to FIG. 9, one of the metal, column-like elements 108 is shown in greater detail. The other various components of the printed wiring board 102 in common with printed wiring board 12 are designated by the same reference numerals used in connection with the description of printed wiring board 12, but are designated with a prime symbol. The metal, column-like element 108 is formed by first drilling a hole (i.e., bore) 112 through the various layers of the probe-integrated printed wiring board 102 and filling the hole 112 with a metal as part of a plating process so that an electrical connection is formed with the ground pad 32'. The finished metal, column-like element 108 essentially forms a "pin" having a generally circular shape when viewed in cross section. Its diameter may vary considerably depending on the specific application and the overall construction of the antenna system 100, but in one preferred form is preferably between about 0.020 inch (0.508 mm) and about 0.1 inch (2.54 mm), and more preferably between about 0.040 inch (1.016 mm) and about 0.080 inch (2.032 mm). It will be appreciated that the metal, column-like element 108 could readily comprise other cross-sectional shapes as well. The cross sectional shape will obviously be dictated by the shape of the hole 112 that is formed in the probe-integrated printed wiring board 102.

Figure 10:
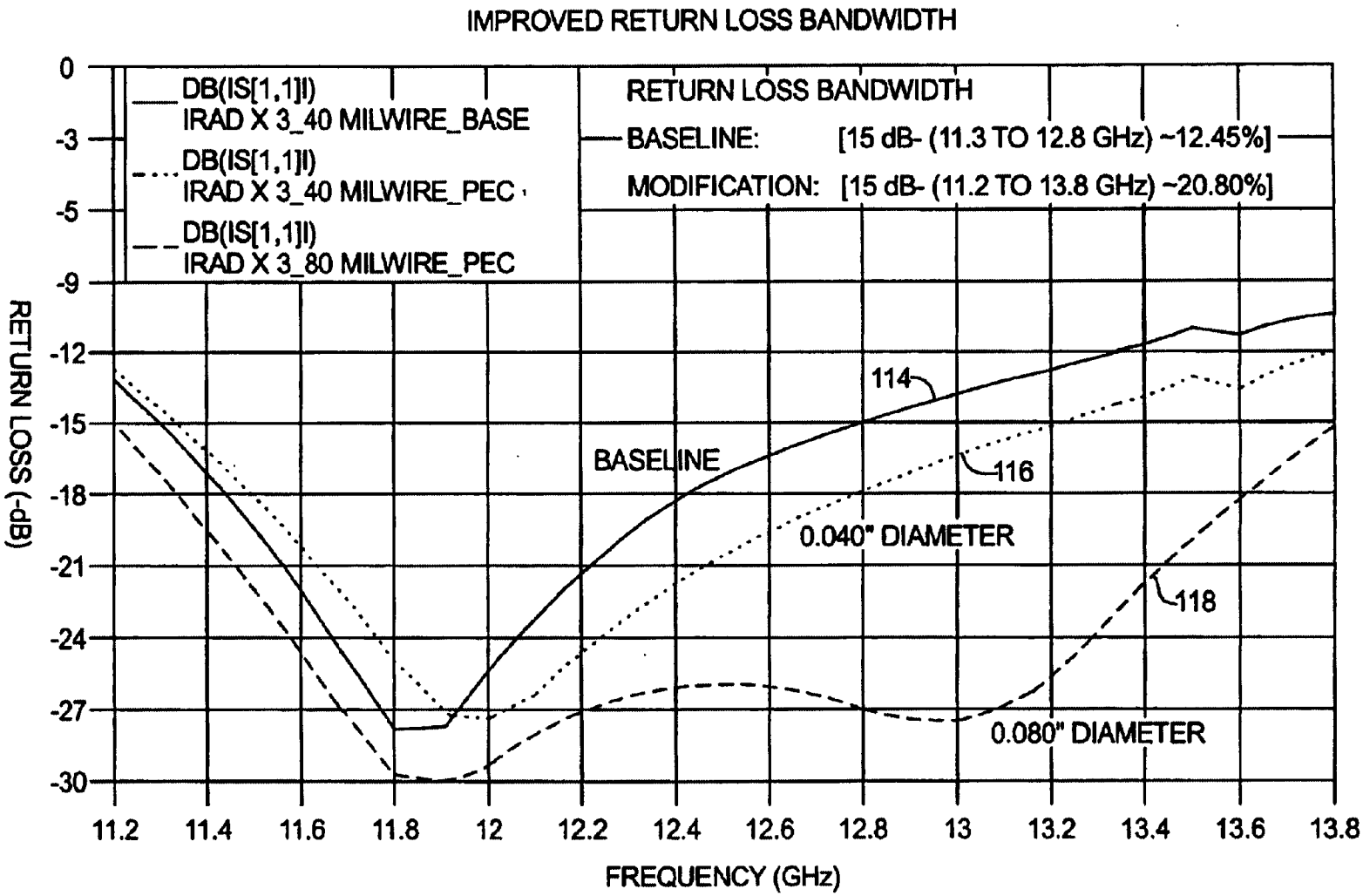
FIG. 10 is a graph illustrating the improvement in return loss bandwidth provided by the metal, column-like elements of the antenna system of FIG. 8.

It will be appreciated that for a dual polarized radiator, there are several characteristic used to gauge the effectiveness of the design. These characteristics include return loss bandwidth, probe-to-probe isolation, insertion loss bandwidth, higher order mode suppression and cross polarization levels. Referring to FIG. 10, the improvement in return loss bandwidth can be seen by the comparison between a probe design used in a dual polarization receive (DPR) antenna that does not incorporate the metal column-like elements 108, whose return loss bandwidth is illustrated by curve 114, and probes that do, whose curves are designated by reference numerals 116 and 118. Curve 116 represents a metal, column-like element 108 having a diameter of 0.040 inch and curve 118 indicates the performance with a 0.080 inch diameter element 108. Curve 114 illustrates a 15 dB return loss level at 12.8 GHz, which is a typical return loss value. As shown by curve 116, the metal, column-like elements 108 having a diameter of 0.040 inch increase the return loss bandwidth from about 11.3 GHz to about 13.2 GHz, which is approximately 3 dB less than curve 114 at 12.8 GHz. As shown by curve 116, metal, column-like elements 108 having a diameter of 0.080 inch increase the return loss bandwidth from about 11.3 GHz to about 13.8 GHz, which is approximately 12 dB less than curve 114 at 12.8 GHz for an improvement of about 20.80% when elements 108 are incorporated.

Figure 11:
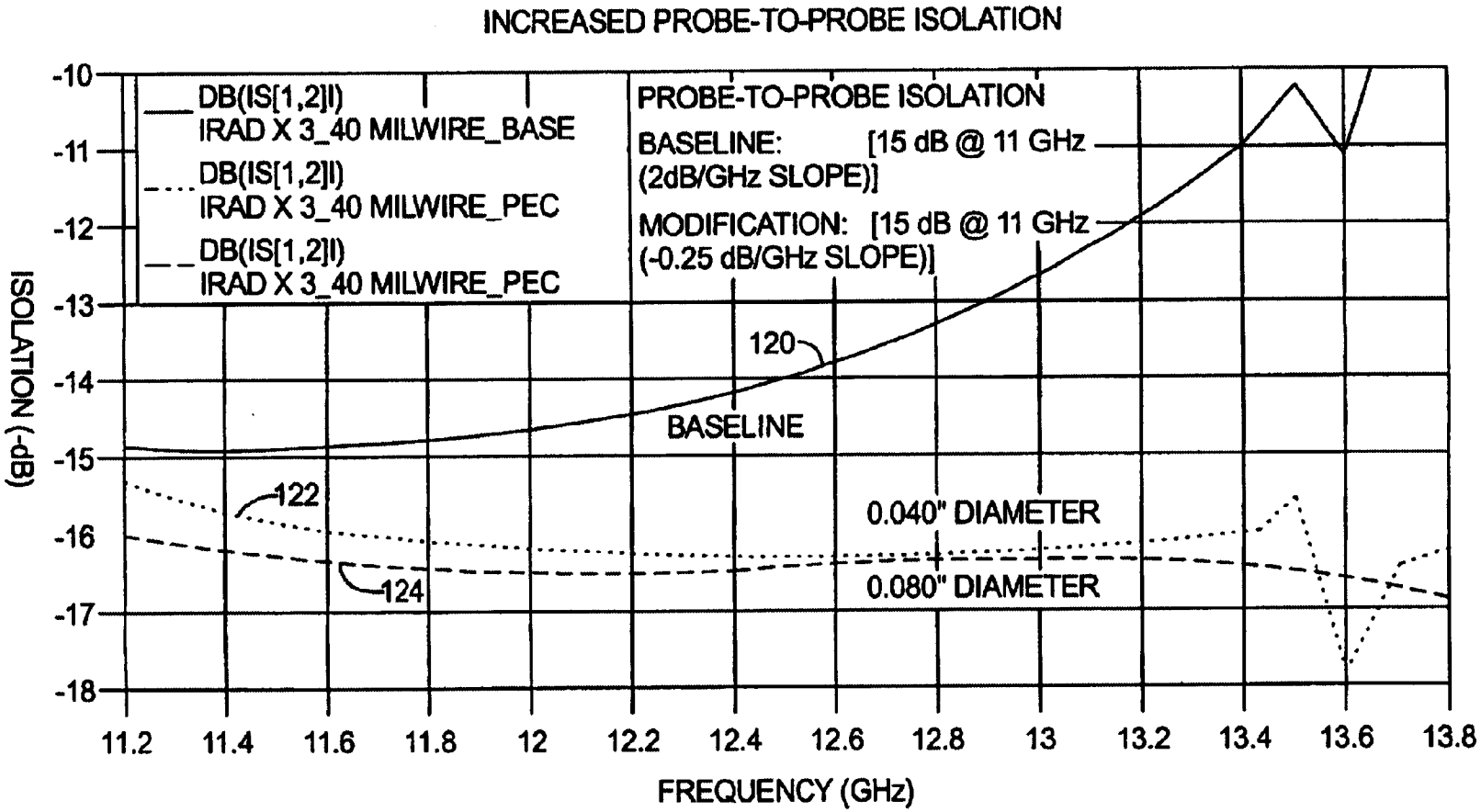
FIG. 11 is a graph illustrating the improvement in probe-to-probe isolation provided by the antenna system of FIG. 8.

A radiator's probe-to-probe isolation is another important characteristic that determines the interaction between inputs applied to each of the RF probes of a dual polarization radiator. FIG. 11 compares the probe-to-probe isolation slope over the operating bandwidth of the antenna. The baseline radiator 120 has 15 dB isolation at 11 GHz with a +2 dB/GHz slope. Curve 122 indicates the performance gain when a 0.040 inch element 108 is incorporated. Curve 124 indicates the isolation provided by a 0.080 inch diameter element 108, which provides a −0.25 dB/GHz slope. This a given pair of RF probes 110 to continue to be isolated over a larger operating bandwidth.

Figure 12:
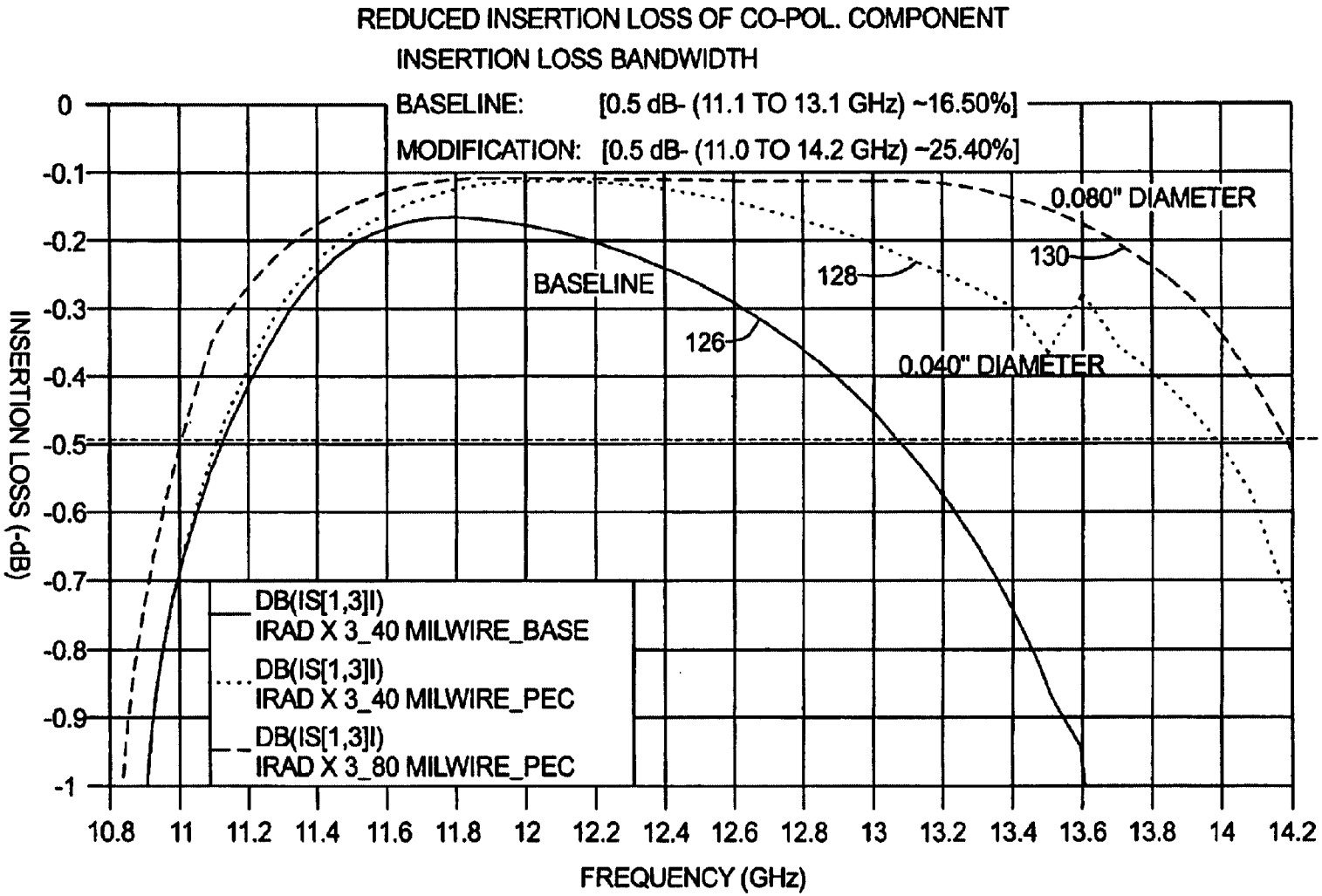
FIG. 12 is a graph illustrating the improvement in insertion loss for the antenna system of FIG. 8.

FIG. 12 illustrates the improvement in the co-polarization insertion loss bandwidth provided by the metal, column-like elements 108. The co-polarization insertion loss bandwidth represents the loss in energy at the inputs to the RF probes caused by ohmic and dielectric losses, cross-polarization components and to higher order mode conversion. Choosing a 0.5 dB insertion loss for comparison, represented by curve 126, shows that a baseline radiator can operate from 11.1 GHz to 13.1 GHz for a variation of 16.5%. The increase in bandwidth when including the 0.0.040 inch metal, column-like element 108 is represented by curve 128. The increase in bandwidth when incorporating a 0.080 inch element 108 is represented by curve 130. Curve 130 increases the 0.5 dB insertion loss bandwidth from 11.0 GHz to 14.2 GHz or by 25.4% This increased bandwidth, even if not needed by an application, increases manufacturing yield, reduces component tolerances and reduces electrical variations in an array environment over a range of scan angles.

Figure 13:
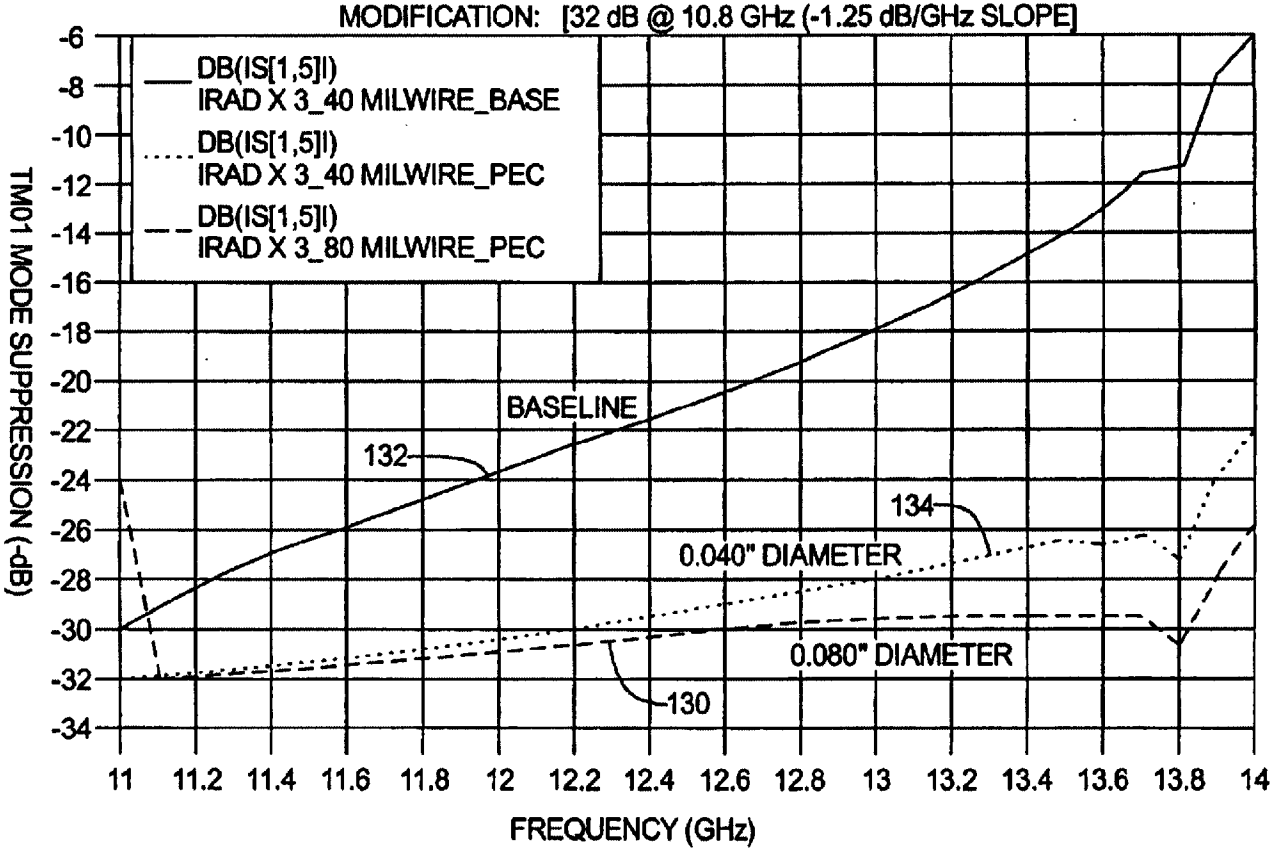
FIG. 13 is a graph illustrating the improvement in higher order mode suppression for the antenna system of FIG. 8.

FIG. 13 illustrates the increase in higher order mode suppression provided by the antenna system 100. Suppressing the generation and propagation of the next higher order allows the operating bandwidth of a radiator to be increased. For a circular waveguide radiator, the TM01 mode is the next higher order mode which, if generated, will increase the co-polarization insertion loss of the element. FIG. 13 illustrates a curve 132 representing the next higher order mode suppression of a baseline probe having 32 dB suppression at 10.8 GHz with a +6 dB/GHz slope. Curve 134 illustrates the improvement in suppression provided by the use of metal column-like elements 108 having a diameter of 0.040 inch. Curve 136 illustrates the improvement in suppression provided by an element 108 having a diameter of 0.080 inch. The 0.080 inch diameter element 108 also provides 32 dB suppression at 10.8 GHz but reduces the slope to −1.25 dB/GHz. The shows that the element 108 further serves to suppress the TM01 mode throughout the operating bandwidth of the radiator. This translates to more predictable element performance and reduced mode conversion losses.

Figure 14:
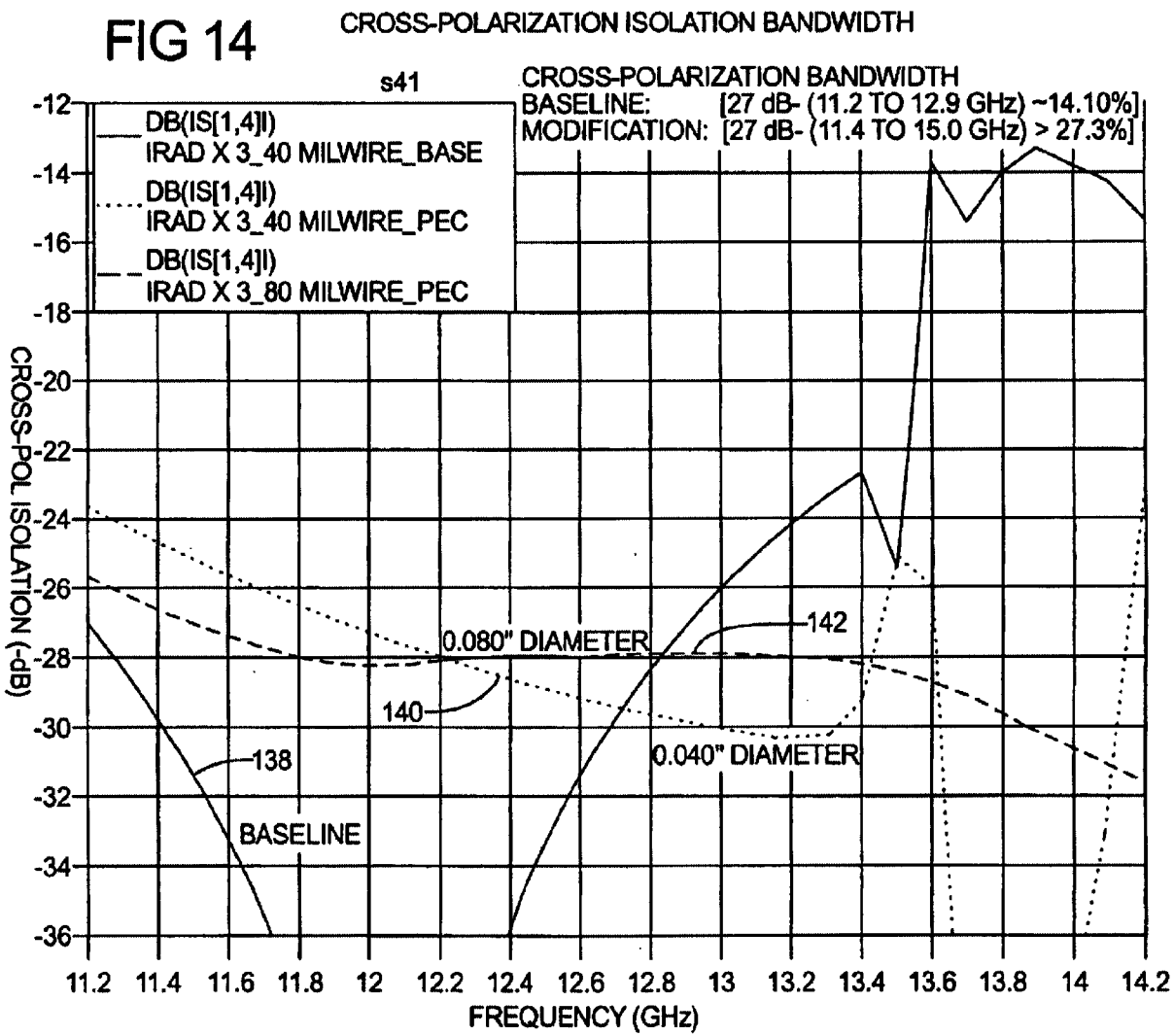
FIG. 14 is a graph illustrating the improvement in cross-polarization isolation bandwidth for the antenna system of FIG. 8.

FIG. 14 shows how the use of the metal, column-like elements 108 serve to even further improve the cross-polarization isolation. Curve 138 represents a typical prior art dual polarization radiator having a −27 dB cross-polarization level over a 14.1 bandwidth. Curves 140 and 142 illustrate the gain in bandwidth when 0.040 inch and 0.080 diameter metal, column-like elements 108, respectively, are employed in the antenna system 100. Curve 142 shows a −27 dB cross-polarization level over a frequency range of 11.4 G Hz to 15 GHz, or a 27.3% bandwidth. Thus, the baseline radiator "nulls" out the cross-polarization near the middle of its operating bandwidth while the antenna system 100 maintains a near-flat −27 dB response. The near-flat response serves to increase the useful operating bandwidth of the element.

Figure 15:
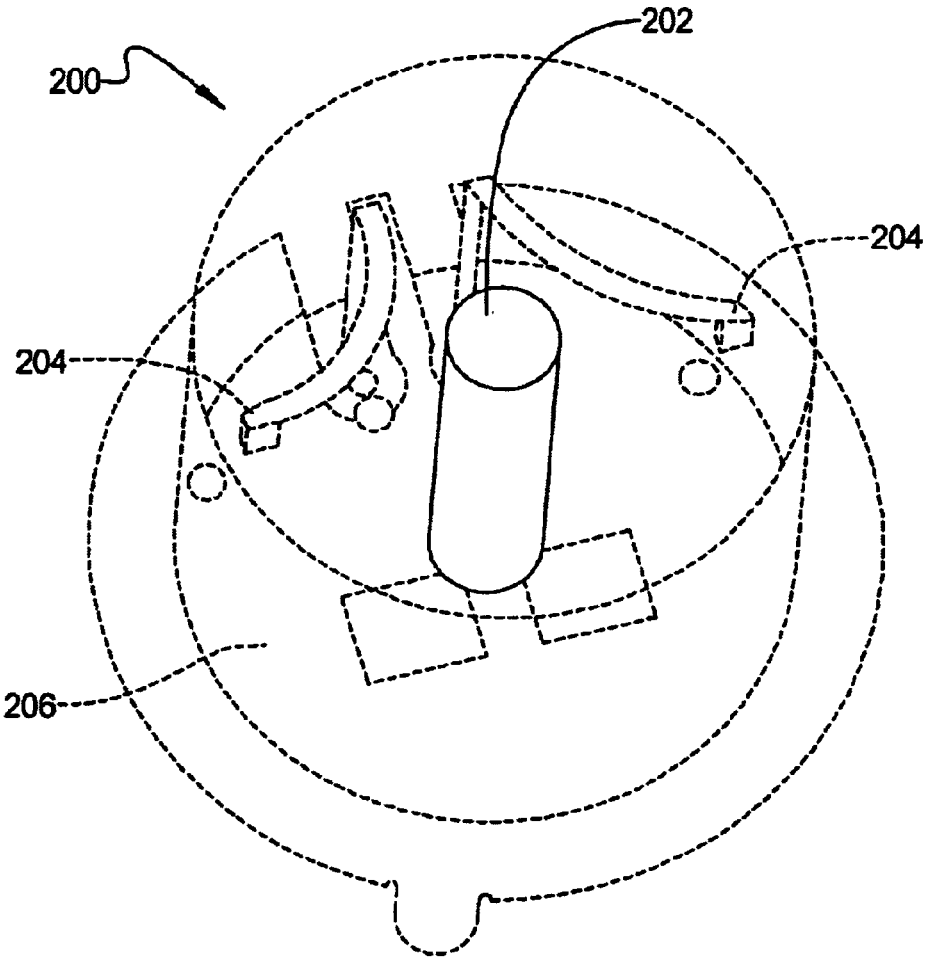
FIG. 15 is a view of another preferred implementation of the metal, column-like elements, illustrating one such element disposed within an injection molded antenna module.

It will be appreciated that while the use of the metal-column like elements 108 have been described and illustrated in connection with probe-integrated printed wiring board 102, that the elements 108 could be implemented into virtually any design of dual polarization radiator with only minor manufacturing modifications. For example, referring to FIG. 15, an antenna module 200 in accordance with another alternative preferred embodiment 200 of the present invention is shown. Antenna module 200 is injection molded and includes a metal pin 202 molded in between a pair of probes 204 within a plastic body portion 206. The metal pin 202 has a thickness of preferably between about 0.020 inch and 0.10 inch, and more preferably between about 0.040 inch and 0.080 inch. Thus, it will be appreciated that a metal pin 202 or other form of metal, column-like element could readily be implemented in the antennas disclosed in U.S. Pat. Nos. 5,276,455 and 5,886,671 with relatively minor manufacturing modifications.

The preferred embodiments disclosed herein thus provide a means for forming a phased array antenna from a significantly fewer number of component parts, as well as improving the electrical performance of a phased array antenna system. The metal, column-like elements 108 serve to significantly cancel out any higher order modes which were previously generated and suppress the cross-talk over nearly twice the operating bandwidth of an antenna that does not incorporate the elements 108.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An antenna module comprising:

a plurality of radio frequency (RF) radiating elements defining a surface plane for transmitting RE energy;

a plurality of metal, column-like structures disposed to circumscribe each of said RF radiating elements so as to fully enclose each said RF radiating element and extending beyond said surface plane to act as a waveguide for each of said RF radiating elements and for suppressing a next, higher order mode of the antenna module, to increasing a cross polarization isolation of said RF radiating elements over an operating bandwidth of said antenna module as said RF energy is transmitted.

2. The antenna module of claim 1, wherein said metal, column-like structures each comprise a generally circular, column-like structure when viewed in cross section.

3. The antenna module of claim 2, wherein said metal, column-like structures each comprise a diameter of at least about 0.020 inch (0.508 millimeter).

4. The antenna module of claim 3, wherein said metal, column-like structures each comprise a diameter of between about 0.040 inch (1.016 millimeters) to about 0.080 inch (2.032 millimeters).

5. The antenna module of claim 1, further including a ground element; and wherein each said metal, column-like structure is coupled to said ground element.

6. The antenna module of claim 1, wherein each said metal, column-like structure comprises a metal pin.

7. An antenna comprising:

a pair of radio frequency (RF) probes formed on a printed wiring board and disposed adjacent one another for transmitting RF energy, said RF probes having a portion defining a surface plane;

a ground element;

a plurality of metal elements disposed to circumscribe said RF probes, and electrically coupled to said ground element; and said metal elements forming a metallic wall structure that extends beyond said surface plane to act as a waveguide for said RF probes and to suppress a next, higher order mode of the antenna to thereby increase a cross-polarization isolation of said RF radiating elements over an operating bandwidth of said antenna module.

8. The antenna of claim 7, wherein said metal elements each comprise a metal column.

9. The antenna of claim 7, wherein each said metal element comprises a cylindrical shape.

10. The antenna of claim 9, wherein each said metal element comprises a diameter of at least about 0.020 inch (0.508 millimeter).

11. The antenna of claim 9, wherein each said metal element comprises a diameter of between about 0.040 inch (1.016 millimeters) to about 0.080 inch (2.032 millimeters).

12. An antenna module comprising:

a pair of radio frequency (RF) radiating elements for transmitting horizontally and vertically polarized RF energy, said RF radiating elements being formed on a first printed wiring board;

a ground element disposed adjacent said first printed wiring board; and a plurality of metal, column-like members formed in a second printed wiring board disposed adjacent said first printed wiring board, said metal, column-like members being electrically coupled to said ground element and disposed to fully circumscribe each of said pair of RF radiating elements to act as waveguides for said RF radiating elements, and for suppressing a next, higher order mode of the antenna module, thereby increasing a cross polarization isolation of said RF radiating elements.

13. The antenna module of claim 12, wherein each said metal, column-like member comprises an elongated member having a cylindrical shape when viewed in cross section.

14. The antenna module of claim 13, wherein each said metal, column-like member comprises a diameter of at least about 0.020 inch (0.508 millimeter).

15. The antenna module of claim 13, wherein each said metal, column-like member comprises a diameter of between about 0.040 inch (1.016 millimeters) and 0.080 inch (2.032 millimeters).

16. A method of forming an antenna system comprising:

a) providing a pair of radio frequency (RF) radiating elements formed on a first printed wiring board, said RF radiating elements defining a surface plane;

b) providing a planar ground element disposed adjacent said first printed wiring board;

c) supplying RF energy to said radiating elements; and d) using a plurality of metal, column-like elements formed in a second printed wiring board and disposed to at least partially circumscribe each of said radiating elements, and extending beyond said surface plane and being electrically coupled to said ground element so as to fully enclose each said radiating element to suppress a next, higher order mode of the antenna system, to increase a cross-polarization isolation of said radiating elements over an operating bandwidth of said antenna system and to act as a waveguide for said antenna system.

17. The method of claim 16, wherein step d) further comprises the step of using metal, column-like elements each having a diameter of at least about 0.020 inch (0.508 millimeter).

18. The method of claim 17, wherein step d) comprises using metal, column-like elements each having a diameter of between about 0.040 inch (1.016 millimeters) and 0.080 inch (2.032 millimeters).

* * * * *